US007347275B2

(12) United States Patent
Fontenot et al.

(10) Patent No.: US 7,347,275 B2
(45) Date of Patent: Mar. 25, 2008

(54) APPARATUS AND METHOD TO DETECT ACTUATION OF A FLOW CONTROL DEVICE

(75) Inventors: Robert J. Fontenot, Houston, TX (US); Donald W. Ross, Houston, TX (US); Michele Arena, Rome (IT)

(73) Assignee: Schlumberger Technology Corporation, Sugar Land, TX (US)

( * ) Notice: Subject to any disclaimer, the term of this patent is extended or adjusted under 35 U.S.C. 154(b) by 326 days.

(21) Appl. No.: 11/160,211

(22) Filed: Jun. 14, 2005

(65) Prior Publication Data

US 2005/0279496 A1 Dec. 22, 2005

Related U.S. Application Data

(60) Provisional application No. 60/521,685, filed on Jun. 17, 2004.

(51) Int. Cl.
*E21B 34/16* (2006.01)

(52) U.S. Cl. ..... 166/386; 166/250.01; 166/334.4

(58) Field of Classification Search ..... 166/66, 166/319, 386, 250.01, 255.1, 332.1, 334.1, 166/334.4

See application file for complete search history.

(56) References Cited

U.S. PATENT DOCUMENTS

| | | | | |
|---|---|---|---|---|
| 4,884,439 | A | 12/1989 | Baird | |
| 6,041,857 | A | 3/2000 | Carmody et al. | |
| 6,276,458 | B1 | 8/2001 | Malone et al. | |
| 6,328,112 | B1 | 12/2001 | Malone | |
| 6,722,439 | B2 | 4/2004 | Garay et al. | |
| 6,736,213 | B2 * | 5/2004 | Bussear et al. | 166/375 |
| 6,776,240 | B2 | 8/2004 | Kenison et al. | |
| 6,994,162 | B2 * | 2/2006 | Robison | 166/250.01 |
| 7,195,033 | B2 * | 3/2007 | Mayeu et al. | 137/554 |
| 7,201,230 | B2 * | 4/2007 | Schultz et al. | 166/373 |
| 2005/0263279 | A1 * | 12/2005 | Vachon | 166/250.01 |

FOREIGN PATENT DOCUMENTS

| | | | |
|---|---|---|---|
| CA | 2118229 | | 11/1993 |
| CA | 2326900 | | 9/2000 |
| CA | 2484338 | A1 | 11/2004 |
| GB | 2397080 | A | 7/2004 |
| GB | 2398869 | A | 9/2004 |
| WO | WO 01/06130 | A1 | 1/2001 |
| WO | WO 03/042498 | A1 | 5/2003 |

* cited by examiner

*Primary Examiner*—David Bagnell
*Assistant Examiner*—David Andrews
(74) *Attorney, Agent, or Firm*—Trop, Pruner & Hu, P.C.; Bryan P. Galloway

(57) ABSTRACT

An apparatus for use in a wellbore comprises a flow control device having an open position, a closed position, and at least one intermediate position. The apparatus further comprises a chamber and a movable member for actuating the flow control device, where the movable member is movable inside the chamber. The movable member causes a characteristic in the chamber to change in response to movement of the movable member to actuate the flow control device. A sensor detects the change in the characteristic inside the chamber that is indicative of actuation of the flow control device.

23 Claims, 4 Drawing Sheets

APPARATUS AND METHOD TO DETECT ACTUATION OF A FLOW CONTROL DEVICE

CROSS-REFERENCE TO RELATED APPLICATION

This claims the benefit under 35 U.S.C. § 119(e) of U.S. Provisional Application Ser. No. 60/521,685, entitled "Position Feedback Device for Downhole Flow Control Device," filed Jun. 17, 2004.

BACKGROUND

Flow control devices (e.g. valves) are commonly used in wells for controlling fluid communication between different well regions, between a well region and the inside of a tool string, or between different regions of a tool string. Flow control devices can be controlled by one of many different mechanisms, including hydraulic mechanisms, electrical mechanisms, fiber optic mechanisms, and so forth. Hydraulic, electrical, optical, or other types of signals are often communicated through a control line (or multiple control lines) to actuate the flow control device.

A flow control device can be actuated between an open position and a closed position. Often, flow control devices also have at least one intermediate position (a choke position) between the open and closed position in which the flow control device is partially open.

Usually, it is difficult to accurately determine (from a remote location such as from the earth surface of the well) whether a flow control device has been successfully actuated. Feedback regarding actuation of a flow control device is typically provided by detecting one or more indirect indications of flow control device actuation, including (1) detecting the volume of hydraulic fluid pumped into or returned from a control line; (2) detecting a change in well flow volumes either at the surface or at a downhole location detected by a downhole measurement device; and (3) detecting downhole pressure or temperature measurements near the flow control device.

The latter two detection techniques can be inaccurate when actuation of the flow control device causes relatively small changes in the flow condition, such as in a situation where multiple zones are producing and the fluid flow from the multiple zones are commingled, or where a flow control device has many intermediate positions such that actuation of a flow control device between two successive positions causes a small change in fluid flow.

The inability to accurately detect actuation of a flow control device means that well personnel cannot be sure that the flow control device has been actuated. This uncertainty may cause well personnel to incorrectly assume that a flow control device has been actuated, when in fact the flow control device has not; or vice versa.

SUMMARY OF THE INVENTION

According to one embodiment, an apparatus for use in a wellbore comprises a flow control device having an open position, a closed position, and at least one intermediate position. The apparatus further comprises a chamber and a movable member for actuating the flow control device, where the movable member is movable inside the chamber. The movable member causes a characteristic in the chamber to change in response to movement of the movable member to actuate the flow control device. A sensor detects the change in the characteristic inside the chamber that is indicative of actuation of the flow control device.

In general, according to another embodiment, a method for use in a wellbore comprises actuating a downhole device by moving a member; providing a chamber, at least a portion of the member movable in the chamber; and detecting a change in an environmental characteristic inside the chamber resulting from movement of the member in the chamber.

Other or alternative features will become apparent from the following description, from the drawings, and from the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
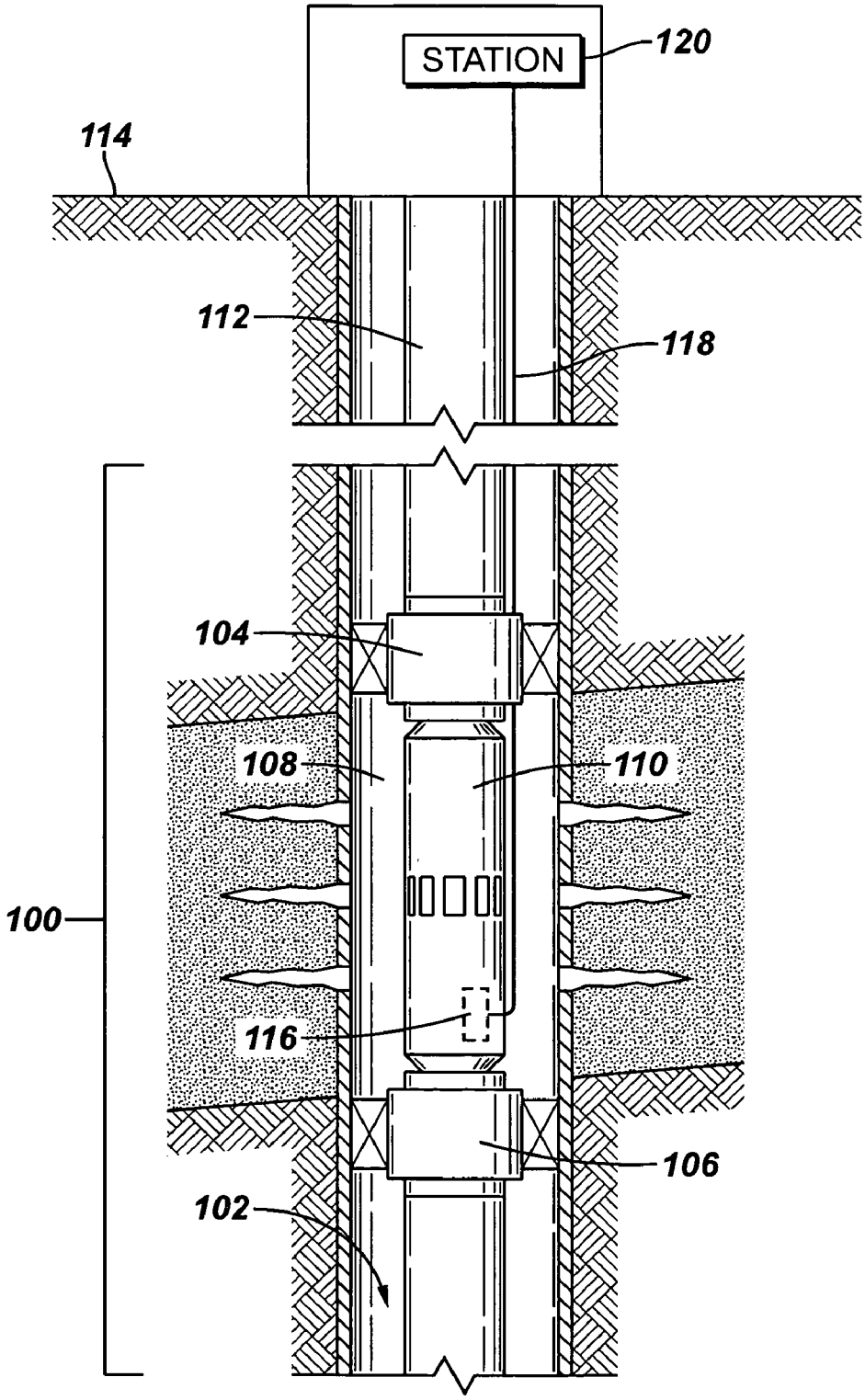
FIG. 1 illustrates a downhole string that incorporates a flow control device according to an embodiment.

FIG. 1 shows an example tool string 100 that can be positioned inside a wellbore 102. The tool string 100 has an upper packer 104 and a lower packer 106. The packers 104 and 106, when actuated, seal an interval 108 in the wellbore 102.

The tool string 100 includes a flow control device assembly 110 between the upper and lower packers 104 and 106. In one example application, the flow control device assembly 110 can be actuated to different positions to control flow of fluids between an inner bore of the tool string 100 and the wellbore 102. For example, the sealed interval 108 may be adjacent a perforated formation such that production of hydrocarbons can be performed from the formation into the tool string 100. The tool string 100 also includes a tubing 112, such as production tubing, that is able to carry hydrocarbons to the earth surface 114 at the well. Instead of producing hydrocarbons, the tool 100 can alternatively be used for injecting fluids down the tubing 112 and through the flow control device assembly 110 into the surrounding formation. In an alternative arrangement, the flow control device assembly 110 can be used to control flow inside the tool string 100 as well, such as controlling flow through an inner bore of the tool string 100 that couples different zones of the well.

In accordance with some embodiments of the invention, the flow control device assembly 110 includes a sensor (or multiple sensors) 116. Example sensors include pressure sensors, temperature sensors, and other types of sensors. Generally, the sensor(s) 116 is (are) used to detect a characteristic (such as pressure, temperature, and so forth) in the well.

In accordance with some embodiments of the invention, at least one sensor 116 can be used for the purpose of detecting actuation of the flow control device assembly 110 among different positions of the flow control device. For example, the flow control device assembly 110 can have an open position, a closed position, and at least one intermediate position. The at least one sensor 116 is able to detect a change in characteristic that results from actuation of the flow control device assembly 110. In accordance with some embodiments, this change in characteristic occurs as a result of movement of a movable member of the flow control device assembly 110 inside a predefined chamber, described further below. The detection of the change in characteristic (e.g., temperature, pressure) inside the predefined chamber allows for a more direct detection of the actuation of the flow control device assembly 110. Temperature and pressure are examples of environmental characteristics.

The sensor(s) is (are) coupled by a communication line (or multiple communication lines) 118 to a surface station 120. Information gathered by the sensor(s) is communicated to the surface station 120 to provide indications of downhole conditions, including indications of actuations of the flow control device assembly 110. Instead of being coupled to a surface station 120, the communication line(s) 118 can alternatively be coupled to equipment located inside the wellbore 102. Examples of the communication line(s) 118 include electrical communication lines, fiber optic communication lines, hydraulic communication lines, and so forth. Instead of using a communication line, a wireless technique can be used to enable communication between the sensor(s) 116 and the surface station 120 or some other station.

Figure 2:
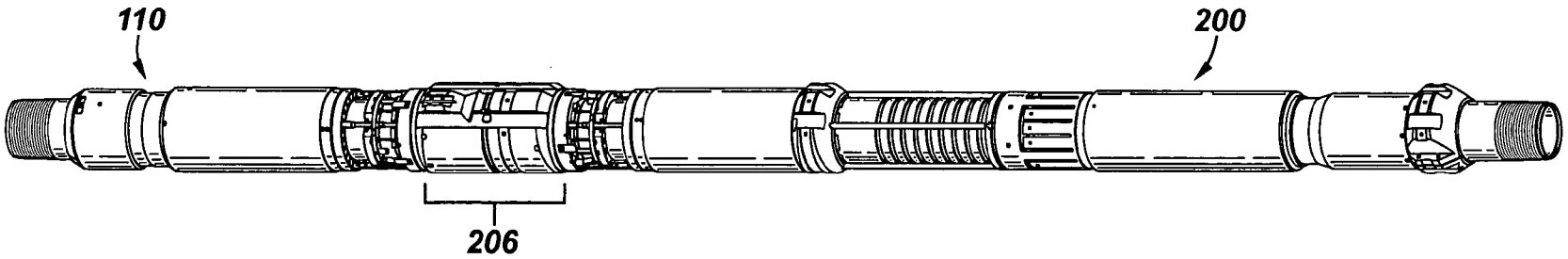
FIG. 2 illustrates the flow control device assembly according to an embodiment in slightly greater detail.
Figure 3:
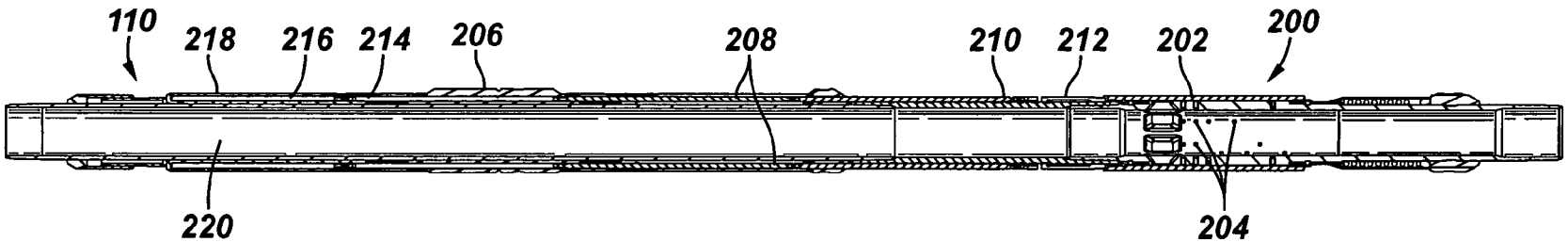
FIGS. 3-4 are cross-sectional views of the flow control device assembly of FIG. 2.
Figure 4:
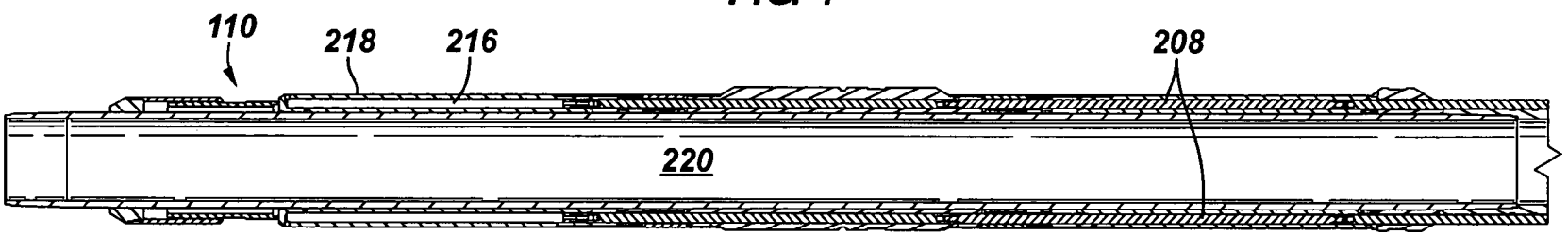

As depicted in FIGS. 2-4, the flow control device assembly 110 includes a choke device 200 that is able to control fluid flow into or out of the tool string 100 (FIG. 1). The choke device 200 is a form of flow control device. In one embodiment, the choke device 200 has discrete positions with choke nozzles 204 in each position to restrict flow. Each choke nozzle 204, according to an embodiment, is basically an opening to allow fluid flow between the wellbore and the inside of the flow control device assembly 110. As shown in the cross-sectional view of FIG. 3, the choke device 200 has an outer sleeve 202 that is movable with respect to the choke nozzles 204. In the depicted embodiment, the choke device 200 is a sleeve valve. However, in other embodiments, other types of valves can be used in the flow control device assembly 110.

Movement of the sleeve 202 successively uncovers the choke nozzles 204 such that changes in flow area between the wellbore and the inner bore 220 of the flow control device assembly 110 occurs to change fluid flow rate between the wellbore and the inner bore 220 of the flow control device assembly 110.

The choke device 200 is actuated by a drive mechanism 206. The drive mechanism 206 incrementally moves the sleeve 202 to successively cover or expose the choke nozzles 204 such that the choke device 200 is incrementally actuated among an open position, a closed position, and at least one intermediate position. In some example implementations, the choke device 200 can have multiple intermediate positions (such as five or greater intermediate positions).

As shown in FIG. 3, the sleeve 202 is actuated by movement of a movable member that, according to one embodiment, is in the form of a drive rod 208 (or plural drive rods). The lower end 210 of the drive rod 208 is coupled by a coupling mechanism 212 to the sleeve 202. Thus, up and down movement of the drive rod 208 causes a corresponding movement at the sleeve 202. The drive rod 208 is operatively connected to the drive mechanism such that the drive rod 208 is incrementally moved by the drive mechanism 206 for actuating the sleeve 202.

An upper end 214 of the drive rod 208 extends into a dampening chamber 216 that is defined inside a housing 218. In the embodiment depicted in FIG. 3, at least a portion of the drive rod 208 extends into the dampening chamber 216. FIG. 3 shows a first position of the drive rod 208 (and a sleeve 202) that corresponds to a closed position, where the sleeve 202 completely covers all the choke nozzles 204 of each choke device 200.

On the other hand, FIG. 4 shows a second position of the drive rod 208 and the sleeve 202 in which the drive rod 208 has moved downwardly such that the choke nozzles 204 are exposed to allow fluid communication between the wellbore and the inner bore 220 of the flow control device assembly 110. Note that the cross-sectional view of FIG. 4 is rotated about 90° with respect to the cross-sectional view of FIG. 3.

Movement of the portion of the drive rod 208 in the dampening chamber 216 causes a temporary change of a characteristic (e.g., pressure) in the dampening chamber 216. In other embodiments, detection of other characteristics in the dampening chamber 216 besides pressure can be employed. The temporary change in characteristic in the dampening chamber 216 caused by movement of the drive rod 208 provides a relatively direct indication of actuation of the flow control device assembly 110. In this manner, detection of actuation of the flow control device from a first position to another position does not have to be based on indirect indications, which can be unreliable.

Figure 5:
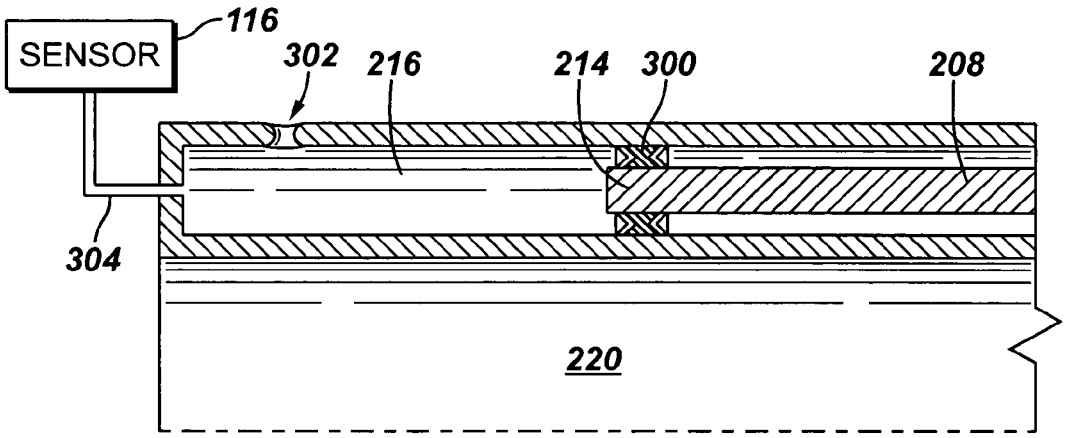
FIG. 5 illustrates a mechanism that can be provided in the flow control device assembly of FIG. 2 to enable detection of actuation of the flow control device assembly, according to one embodiment.

FIG. 5 shows the mechanism for detecting actuation of the flow control device assembly 110 in greater detail. The drive rod 208, at its upper end 214, has one or more seals 300 mounted around the outside of the drive rod 208. A flow restrictor 302 is provided to enable fluid communication (at a relatively slow rate) between the chamber 216 and the wellbore (such as a wellbore annulus region). Alternatively, the flow restrictor 302 can be arranged to allow fluid communication between the chamber 216 and the inner bore of the tool string 100. In accordance with one embodiment, due to the presence of the flow restrictor 302, movement of the drive rod 208 in the chamber 216 will cause a temporary spike in the pressure in the chamber 216. The pressure spike will then dissipate as the pressure equalizes between the chamber 216 and the wellbore through the flow restrictor 302. A "flow restrictor" refers to any structure, such as an opening, metering orifice, or other type of restrictor, where some impedance is provided against rapid fluid flow such that a temporary change in pressure can occur within a chamber due to some stimulus (e.g., movement of a movable member such as the drive rod 208 in the chamber). The flow restrictor is configured (such as by sizing a metering orifice)

to enable the pressure spike to have a sufficiently long duration to enable accurate detection.

A snorkel tube 304 is coupled to the chamber 216. A sensor 116 is able to detect the characteristic change (e.g., pressure spike) in the chamber 216 through the snorkel tube 304. The snorkel tube 304 is basically a control line that allows fluid communication between the sensor 116 and the chamber 216. In this way, the sensor 116 is able to detect temporary spikes of pressure in the chamber 216. In other embodiments, the sensor 116 can be used to detect other types of temporary changes in characteristic (such as temperature and so forth) in the chamber 216.

Figure 6:
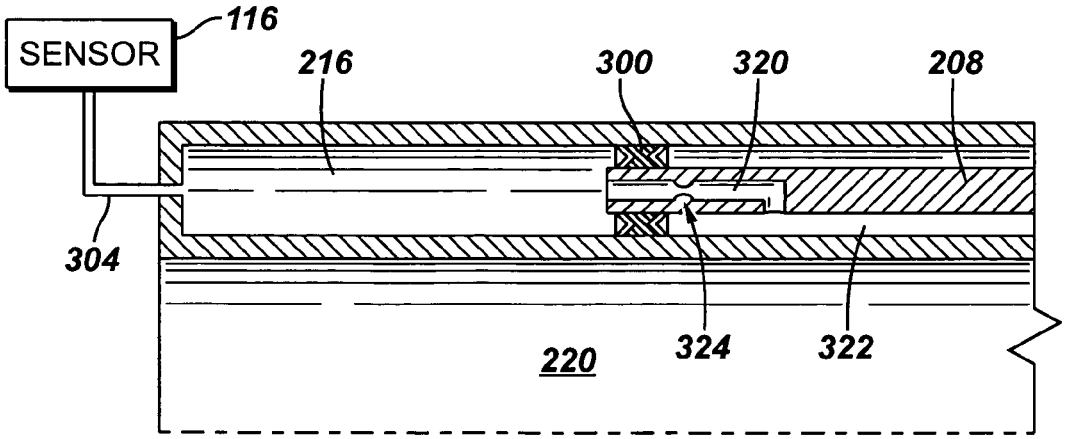
FIG. 6 illustrates a mechanism that can be provided in the flow control device assembly of FIG. 2 to enable detection of actuation of the flow control device assembly of FIG. 2, according to another embodiment.

FIG. 6 shows a different embodiment in which the upper end 214 of the drive rod 208 has an inner bore 320 that allows fluid communication between the chamber 216 and a second, annular chamber 322 (inside the flow control device assembly) that is defined outside the drive rod 208. A flow restrictor 324 is provided in the inner bore 320 of the drive rod 208. The flow restrictor 324 behaves in similar fashion as the flow restrictor 302 to cause temporary spikes in pressure in the chamber 216 due to movement of the drive rod 208 in the chamber 216).

Unlike the embodiment of FIG. 5, communication through the flow restrictor 302 of FIG. 6 is between the chamber 216 and a chamber (322) in the tool string 100 (such as in the flow control device assembly 110 itself). In contrast in FIG. 5, the flow restrictor 302 enables fluid communication between the chamber 216 and the outside wellbore (the wellbore environment outside the tool string 100 or flow control device assembly 110.

Figure 7:
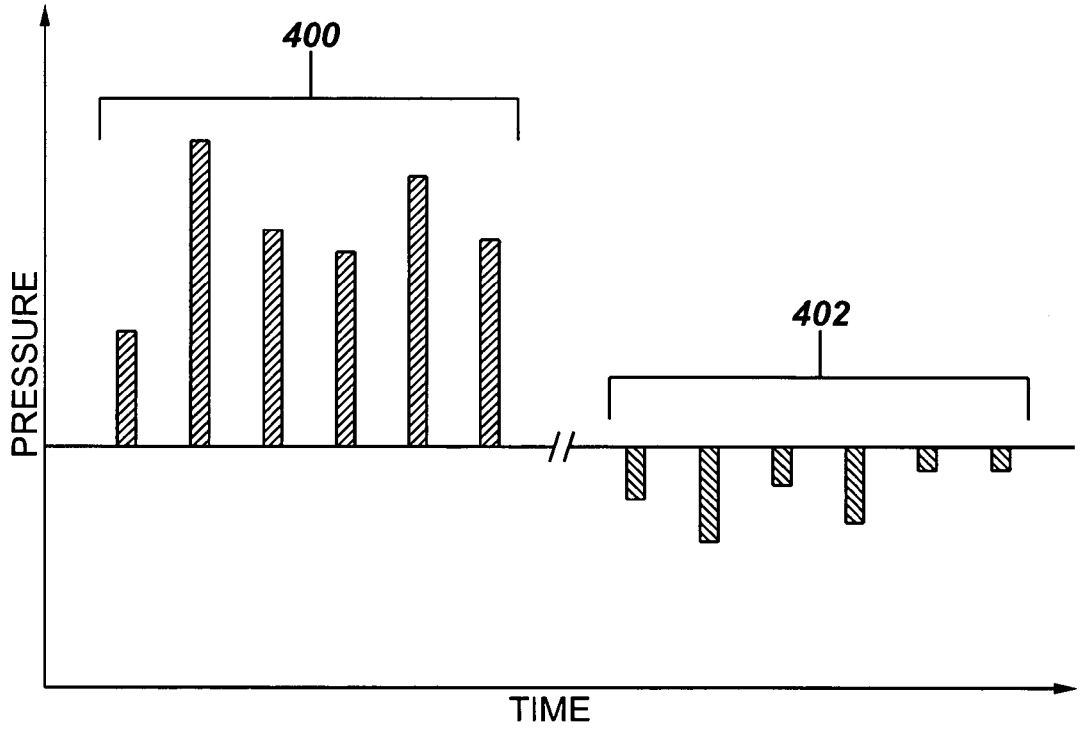
FIG. 7 is a timing diagram of pressure spikes detected by the mechanism of FIG. 5 or 6 that indicate actuation of the flow control device assembly of FIG. 2.

FIG. 7 shows a timing diagram that shows pressure spikes that result from actuation of the choke device 200 (FIG. 2). The timing diagram of FIG. 6 shows a series of positive pressure spikes 400 that correspond to pressure spikes caused by upward movement of the drive rod 208. The timing diagram also shows a series of negative pressure spikes caused by downward movement of the drive rod 208. In an alternative implementation, negative pressure spikes indicate downward movement of the drive rod 208, whereas positive pressure spikes indicate upward movement of the drive rod 208.

The absolute values of the pressure spikes depicted in FIG. 7 are not necessarily important to the detection of flow control device actuation. The mechanism according to some embodiments provides reliable detection of flow control device actuation by detecting presence of the pressure spikes by the sensor 116.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

a flow control device having an open position, a closed position, and at least one intermediate position;

a chamber;

a movable member for actuating the flow control device, the movable member movable inside the chamber, the movable member to cause a temporary pressure spike in the chamber in response to movement of the movable member to actuate the flow control device; and a sensor to detect the temporary pressure spike inside the chamber that is indicative of actuation of the flow control device.

2. The apparatus of claim 1, further comprising a flow restrictor to communicate fluid between the chamber and another region, the flow restrictor to equalize pressure between the chamber and the another region after occurrence of the temporary pressure spike.

3. The apparatus of claim 1, further comprising a remote station and a communication line to communicate with the sensor, the remote station to receive information from the sensor over the communication line regarding an indication of actuation of the flow control device.

4. An apparatus for use in a weilbore, comprising:

a flow control device;

a chamber for containing a fluid;

a movable member for actuating the flow control device, at least a portion of the movable member being inside the chamber; and a sensor coupled to the chamber to detect a temporary pressure spike in the chamber responsive to movement of the movable member in the chamber for actuating the flow control device, the temporary pressure spike indicative of actuation of the flow control device.

5. The apparatus of claim 4, wherein the flow control device has plural positions, the movable member to cause the temporary pressure spike in the chamber in response to movement of the movable member in the chamber to cause the flow control device to be actuated from one of the plural positions to another one of the plural positions.

6. The apparatus of claim 5, wherein the plural positions comprise at least first, second, and third positions, the movable member to cause a first temporary pressure spike in the chamber in response to the movable member moving to actuate the flow control device from the first position to the second position, and the movable member to cause a second temporary pressure spike in the chamber in response to the movable member moving to actuate the flow control device from the second position to the third position, the sensor to detect the first and second temporary pressure spikes.

7. The apparatus of claim 6, wherein the first and second temporary pressure spikes are positive pressure spikes, the movable member to cause a third temporary pressure spike in the chamber in response to the movable member moving to actuate the flow control device from the third position to the second position, and the movable member to cause a fourth temporary pressure spike in response to the movable member moving to actuate the flow control device from the second position to the first position, the third and fourth temporary pressure spikes being negative pressure spikes, the sensor to detect the third and fourth temporary pressure spikes.

8. The apparatus of claim 4, further comprising a snorkel line to communicate pressure from the chamber to the sensor.

9. The apparatus of claim 4, further comprising a fluid flow restrictor between the chamber and a well region.

10. An apparatus for use in a wellbore, comprising:

a flow control device;

a chamber for containing a fluid;

a movable member for actuating the flow control device, at least a portion of the movable member being inside the chamber;

a sensor coupled to the chamber to detect pressure change in the chamber responsive to movement of the movable member in the chamber for actuating the flow control device, the pressure change indicative of actuation of the flow control device; and a fluid flow restrictor positioned to enable fluid communication between the chamber and another region, and wherein the another region comprises one of a well region and a tubing bore.

11. The apparatus of claim 10, wherein the movable member comprises a rod actuatably coupled to the flow control device.

12. The apparatus of claim 11, further comprising a drive mechanism coupled to the rod, the drive mechanism to incrementally move the rod to successively actuate the flow control device among a closed position, an open position, and at least one intermediate position.

13. The apparatus of claim 10, further comprising a communication line to enable communication of pressure information between the sensor and another element.

14. An apparatus for use in a wellbore, comprising:

a flow control device;

a chamber for containing a fluid:

a movable member for actuating the flow control device, at least a portion of the movable member being inside the chamber;

a sensor coupled to the chamber to detect pressure change in the chamber responsive to movement of the movable member in the chamber for actuating the flow control device, the pressure change indicative of actuation of the flow control device; and a fluid flow restrictor positioned to enable fluid communication between the chamber and another region, and wherein the chamber comprises a first chamber, the apparatus further comprising a second chamber sealed from the first chamber except through the fluid flow restrictor, the another region defined by the second chamber.

15. An apparatus for use in a wellbore, comprising:

a flow control device;

a chamber for containing a fluid;

a movable member for actuating the flow control device, at least a portion of the movable member being inside the chamber;

a sensor coupled to the chamber to detect pressure change in the chamber responsive to movement of the movable member in the chamber for actuating the flow control device, the pressure change indicative of actuation of the flow control device, and wherein the movable member has an inner bore to communicate fluid between the chamber and another region in the apparatus;

a seal mounted to an outside surface of the movable member; and a fluid flow restrictor positioned in the inner bore.

16. A method for use in a wellbore comprising:

actuating a downhole device by moving a member;

providing a chamber, at least a portion of the member movable in the chamber;

detecting a pressure spike inside the chamber resulting from movement of the member in the chamber; and allowing the pressure spike to dissipate from the chamber to another region through a flow restrictor.

17. The method of claim 16, wherein detecting the pressure spike comprises detecting a temporary pressure spike.

18. The method of claim 16, wherein actuating the downhole device comprises moving the member to actuate a flow control device from a first position to a second position, and wherein detecting the pressure spike comprises detecting the pressure spike to provide an indication of actuation of the flow control device.

19. The method of claim 18, further comprising:

actuating the flow control device from the second position to a third position; and detecting another pressure spike in the chamber to provide an indication of actuation of the flow control device from the second position to the third position.

20. A system comprising:

a chamber;

a flow control device having a movable actuating member movable inside the chamber; and a sensor to detect a pressure spike in the chamber in response to movement of the movable actuating member inside the chamber, wherein the actuating member comprises an inner bore, the system further comprising a flow restrictor in the inner bore that communicates fluid between the chamber and another region.

21. The system of claim 20, further comprising a station to communicate with the sensor, the sensor to communicate an indication of the pressure spike to the station that provides feedback regarding actuation of the flow control device.

22. The system of claim 20, wherein the pressure spike is caused by movement of the actuating member in the chamber.

23. The system of claim 20, further comprising an annular region around the actuating member, the another region comprises the annular region.

* * * * *